United States Patent [19]

Montgomery, Jr. et al.

[11] 4,194,791

[45] Mar. 25, 1980

[54] GROOVED EARTHWORKING BIT AND METHOD OF ENHANCING THE LIFE THEREOF

[75] Inventors: Robert H. Montgomery, Jr., Fishertown; Seibert S. Oaks, Everett, both of Pa.

[73] Assignee: Kennametal Inc., Latrobe, Pa.

[21] Appl. No.: 915,908

[22] Filed: Jun. 16, 1978

Related U.S. Application Data

[63] Continuation of Ser. No. 779,077, Nov. 18, 1977, abandoned.

[51] Int. Cl.[2] ..... E21C 35/18

[52] U.S. Cl. ..... 299/86; 175/377; 299/87

[58] Field of Search ..... 299/86, 87, 79; 175/377, 353, 374; 76/108 A, 108 R

[56] References Cited

U.S. PATENT DOCUMENTS

| | | | |
|---|---|---|---|
| 1,143,271 | 6/1915 | Hughs | 175/377 |
| 2,177,332 | 10/1937 | Reed | 175/377 |
| 2,528,300 | 10/1950 | Degner | 175/377 |
| 2,738,965 | 3/1956 | McCarthy | 299/87 |
| 3,361,481 | 1/1968 | Maddock | 299/86 |
| 3,652,130 | 3/1972 | Elde | 299/86 |
| 3,915,246 | 10/1975 | Sheshtawy | 175/317 |

*Primary Examiner*—William F. Pate, III
*Attorney, Agent, or Firm*—Lawrence R. Burns

[57] ABSTRACT

The specification discloses an insert tipped tool bit having grooves formed on the longitudinal periphery of the bit in the parent material supporting the insert and a method of reducing erosion of the insert supporting parent material by forming grooves on the longitudinal periphery of the tool bit and sizing and spacing the grooves so that earth fines can pack in the grooves and create a boundary layer of earth fines around the parent material.

8 Claims, 5 Drawing Figures

GROOVED EARTHWORKING BIT AND METHOD OF ENHANCING THE LIFE THEREOF

This is a continuation of application Ser. No. 779,077, filed Mar. 18, 1977 now abandoned.

BACKGROUND OF THE INVENTION

This invention pertains to earthworking tool bits, especially coal mining tool bits, which utilize hard wear resistant inserts mounted in a forward working portion of the bit and supported by parent material surrounding the insert.

In tool bits of the prior art, it is known that using hard wear resistant inserts formed of cemented hard metal carbides can greatly enhance the tool life of earthworking bits, especially the bits used in coal mining operations.

The earthworking bits have a forward working portion which is designed for impacting and fracturing earth formations and the inserts are used on the tip of the tool bit so as to reduce wear on the bit due to impact and abrasiveness of earth formations. The inserts are supported and held in place by the surrounding parent material of the forward working portion of the bit, and when properly supported in the parent material, can greatly enhance the wear life of the tool bit.

It is the goal when using such an insert tipped tool bit that the wear life of the tool will equal the wear life of the insert material itself. Since such inserts are usually formed of a cemented hard metal carbide material, such as tungsten carbide, such a tool would then have an extremely long life.

Part of the problem in trying to achieve the abovementioned goal of the tool bit life lasting as long as the insert material is the erosion of the parent material supporting the insert. Final wear failure of a tool bit is caused by the loss of the wear resistant insert due to the insert breaking off or separating from the parent material. Usually, this occurs because most of the parent has been washed away and the securing force on the insert is weakened or destroyed.

The prior art approaches to hold the insert secured in the tool for the life of the insert material have centered around either providing a sufficient amount of parent material to be eroded away or trying to protect the parent material by various surface hardening techniques. While these have all had some moderate success, it is believed that the present invention will provide long lasting tool life.

It is an object of the present invention to provide a tool bit with a longer useful life than generally known heretofore.

It is a further object of the present invention to provide a method whereby earthworking tools having insert tipped forward working portions may be provided with a longer useful life by a very simple and efficient means.

BRIEF SUMMARY OF THE INVENTION

According to the present invention, a tool bit of the type having a shank portion for mounting on a support block and a forward working portion for impacting earth materials and an insert mounted in the forward tip of the working portion, has grooves formed on the longitudinal periphery of the parent material supporting the insert with the grooves sized and spaced so as to allow earth fines to become packed in the grooves.

Further disclosed is the method of reducing wear of an insert tipped tool bit by providing grooves on the longitudinal periphery of the parent material supporting the insert and sizing and spacing the grooves so that earth fines may become packed in the grooves thereby reducing the erosion of the parent material. The method of the present invention is preferably performed upon a conical type rotary bit found in wide use in the coal mining industry today.

The exact nature of the present invention will become more clearly apparent upon reference to the following detailed specification taken in connection with the accompanying drawings in which.

DETAILED DESCRIPTION OF THE INVENTION

Figure 1:
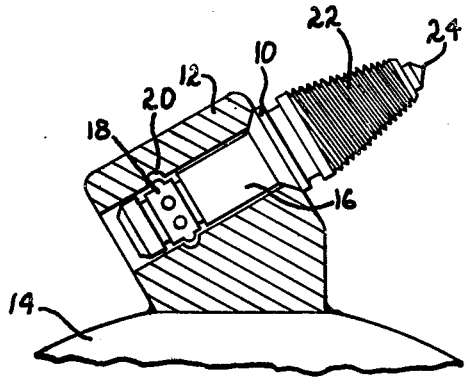
FIG. 1 is a side view of the bit according to the present invention mounted in a typical manner.

Referring to the drawings somewhat more in detail, shown in FIG. 1 is the preferred embodiment of the present invention, showing a coal mining bit 10 mounted in a support block 12 which is, in turn, welded to a rotary drum 14. The tool bit 10 has a rearward shank portion 16 which is mounted in support block 12 and a resilient clip 18 mates with a groove 20 in block 12.

Tool bit 10 is known, or commonly referred to, as a rotary conical bit with a captive keeper. Tool bit 10 has a forward working portion 22 which is conically shaped and the periphery of which tapers inwardly in the forward direction until, at the foremost tip, there is an insert 24 which is formed of a hard wear resistant material. The hard wear resistant material is usually a cemented hard metal carbide and, preferably, tungsten carbide.

Drum 14 is usually rotated in the direction of the arrow, and the forward working portion 22 of bit 10 is used to impact and fracture coal formations. As the bit is designed to allow free rotation of the bit with the holder, this rotation provides a self-sharpening effect such that the parent material of the forward working section 22 would wear in as even a manner as possible and, therefore, insert 24 will be maintained on the tip of tool bit 10 for as long as possible.

Were it not for the rotation of the tool bit 10, the parent material would quickly wear into a flat condition along one side of the periphery and insert 24 could easily be broken out of the parent material. Rotation of the tool bit 10, therefore, aids the tool life in that, as was stated above, the parent material of 22 will wear evenly and itself give a longer life to the tool bit.

Figure 2:
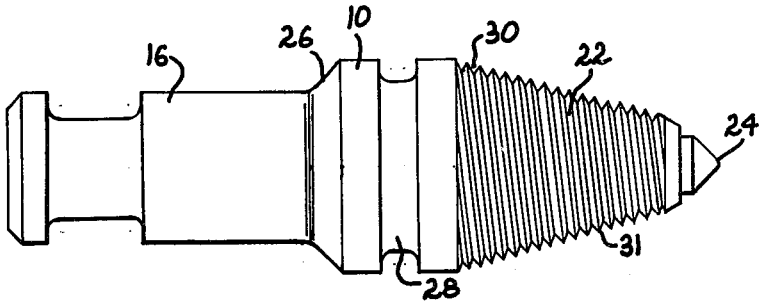
FIG. 2 is a plan view of the bit according to the present invention.

What is shown in FIG. 2 is tool bit 10 having a rear shank portion and a forward working portion 22 with forward working portion 22 forming a parent material which surrounds hard wear resistant insert 24. A shoulder 26 joins the shank 16 to a mid section 28. Extending forwardly of mid section 28 is forward working portion 22. Grooves or threads 30 are formed in the longitudinal outer periphery of the forward working portion 22.

The grooves 30 are formed annularly around the periphery in the proximity of insert 24 and are distributed rearwardly toward the shank portion 16. With the bit shown in FIG. 2, threads 31 are formed along the conical portion of the tool bit from the insert 24 rearwardly to the mid section 28.

Figure 3:
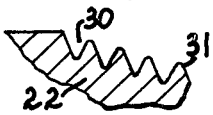
FIGS. 3 to 5 are modifications of the grooves according to the present invention.

Referring now to FIG. 3, what is shown therein is a section of forward working portion 22 having threads 31 formed therein. FIG. 3, of course, is a profile of the conical type bit shown in FIG. 2. Therefore, the forward working portion tapers inwardly in a forward direction. With threads 31 formed in the parent material of forward working portion 22, grooves 30 can then accept earth fines such as coal dust and allow the fines to pack therein when the tool is used under normal working conditions.

The grooves 30 are sized so the fine dust will pack in the grooves and, therefore, there will be no material moving with respect to the threads 31 or the parent material forming the forward working section 22. If the grooves 30 are sized correctly, and the coal files pack in the grooves, then abrasion and wear caused by the earth against which the tool will be working will take place along the layer of earth fines formed just above the peaks of threads 31. In coal mines where water sprays are used for dust suppression, the water will aid in helping the coal dust to pack in the grooves 30.

Figure 4:
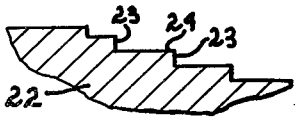

Referring now to FIG. 4, what is shown therein is a forward working portion 22 having a stepped profile such that abutment surfaces 23 are formed adjoining an adjacent surface 24 such that the coal dust or earth fines will pack in along the series of abutment regions 23 to cause the same type of effect as mentioned with reference to the grooves 30 in FIG. 3.

Figure 5:
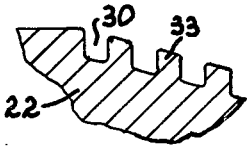

What is shown in FIG. 5 is a modification of the forward working portion 22 having grooves 30 formed therein with the grooves being substantially rectangular in nature and being separated by substantially rectangular ridges 33. Since the forward working portion 22 is tapered, the earth fines or coal dust will be able to pack itself in grooves 30 so as to create a layer of packed coal dust laying somewhat above the tops of the substantially rectangular ridges 33.

Modifications may be made within the scope of the appended claims.

What is claimed is:

1. An earthworking tool comprised of a parent material and having a rearward shank portion for mounting in a support block, a working portion fixed to said shank portion and extending forwardly of said shank portion for engagement with earth material, and a hard wear resistant insert mounted in the parent material of said working portion, grooves formed in and extending around the longitudinal periphery of said working portion in proximity with said hard wear resistant insert, said grooves sized so that earth fines fill the groove and become packed therein substantially reducing erosion of said parent material around the insert.

2. An earthworking tool according to claim 1 in which said grooves comprise threads formed in the proximity of said hard wear resistant insert and extending toward said shank along said working portion.

3. An earthworking tool comprising a rearward shank portion adapted to be rotatably mounted in a support block, a working portion extending forwardly of said shank portion for engagement with earth material, the longitudinal periphery of said working portion tapering inwardly in the forward direction, a hard wear resistant insert mounted in the foremost end of said working portion, grooves allowing earth fines to be packed therein formed in the longitudinal periphery of said working portion in proximity with said hard wear resistant insert.

4. An earthworking tool according to claim 3 in which said grooves comprise threads formed in the proximity of said hard wear resistant insert and extending toward said shank portion.

5. An earthworking tool according to claim 3 in which the depth of each groove is formed inwardly from the longitudinal peripheral surface is uniform for each groove.

6. An earthworking tool according to claim 1 in which said grooves extend circumferentially around said working portion.

7. The method of reducing wear on an earthworking tool bit which comprises mounting a hard wear resistant insert in the parent material near the foremost part of the tool bit that engages the earth, tapering the parent material supporting the insert outwardly rearwardly of the insert, and grooving the longitudinal periphery of the parent material in the proximity of the insert and sizing said grooves so that particle fines of earth material will become packed therein and completely fill the grooves during earthworking operations.

8. The method according to claim 7 in which grooving the longitudinal periphery of the parent material includes the steps of threading the longitudinal periphery in the proximity of the hard wear resistant insert and rearwardly of said hard wear resistant insert.

* * * * *